US007073455B2

(12) United States Patent
Wakazono et al.

(10) Patent No.: US 7,073,455 B2
(45) Date of Patent: Jul. 11, 2006

(54) AUXILIARY TABLE ATTACHABLE TO FREE ARM OF SEWING MACHINE

(75) Inventors: Munehiro Wakazono, Nagoya (JP); Masayuki Hori, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/288,202

(22) Filed: Nov. 29, 2005

(65) Prior Publication Data

US 2006/0112868 A1 Jun. 1, 2006

(51) Int. Cl.
*D05B 73/10* (2006.01)

(52) U.S. Cl. ..... 112/260

(58) Field of Classification Search ..... 112/258, 112/260, 261, 217.1, 217.2; 108/13, 48, 108/56.1, 65, 90, 116, 127; 297/120
See application file for complete search history.

(56) References Cited

U.S. PATENT DOCUMENTS 2,958,304 A * 11/1960 Arbib ..... 112/260
4,168,671 A * 9/1979 Roberts et al. ..... 112/217.1
4,204,493 A * 5/1980 Blackwood et al. ..... 112/260
4,314,517 A * 2/1982 Kasahara et al. ..... 112/260
4,426,944 A * 1/1984 Bianchi ..... 112/260
4,756,119 A * 7/1988 Chabot ..... 47/39
6,401,631 B1 * 6/2002 Kane et al. ..... 108/116

* cited by examiner

*Primary Examiner*—Ismael Izaguirre
(74) *Attorney, Agent, or Firm*—Oliff & Berridge, PLC

(57) ABSTRACT

An auxiliary table detachably attached to a sewing machine includes a table body having a plurality of engagement portions engageable with the engagement supports respectively, the table body having right and left ends, U-shaped first and second support legs mounted on the ends of the table so as to be each switchable between a substantially horizontal retraction position and substantially vertical use position, the second support leg having a lower end. The table body is attached to the free arm while the second support leg is located at the use position and the lower end of the second support leg is inserted in the space between the free arm and the bottom plate, and the lower end of the second support leg is placed on the bottom plate when the table body has been attached to the free arm.

9 Claims, 13 Drawing Sheets

AUXILIARY TABLE ATTACHABLE TO FREE ARM OF SEWING MACHINE

CROSS-REFERENCE TO RELATED APPLICATIONS

This application is based upon and claims the benefit of priority from the prior Japanese Patent Application No. 2004-348583, filed on Dec. 1, 2004, the entire contents of which are incorporated herein by reference.

BACKGROUND

1. Technical Field

The present disclosure relates to an auxiliary table detachably to a sewing machine provided with a sewing bed having a free arm and a bottom plate disposed below the free arm with a predetermined space being defined therebetween and a mounting structure for the auxiliary table.

2. Description of the Related Art

Conventional sewing machines include a type in which an auxiliary table is detachably attached to a free arm of a sewing bed. The auxiliary table has a wide work cloth supporting face so that large work cloth can easily be sewn. For example, JP-Y-59-20235 discloses an auxiliary table comprising a table body further comprising a pair of front and rear table plates connected to each other so as to be foldable and four foldable support legs mounted on four corners of the table body respectively. The table body has an underside provided with claws and protrusions for retaining the paired table plates in an extended state. Furthermore, a plurality of pins and locking members are provided on the auxiliary table and a sewing machine for holding the auxiliary table in an attached state with respect to the sewing machine.

In use of the auxiliary table, both table plates are extended and the claws are engaged with the protrusions respectively. Thereafter, the support legs are raised thereby to be switched to a use position. The auxiliary table is then attached to a sewing bed and the pins of the auxiliary table are engaged with the locking members of the sewing machine respectively. On the other hand, when the auxiliary table is to be detached and kept, the auxiliary table is operated in the reverse order. More specifically, after the auxiliary table is detached from the sewing machine, the support legs are folded thereby to be switched to a retraction position and the table plates are folded.

The above-described auxiliary table needs to be switched to the use position when used and to the retraction position when kept. Accordingly, a switching work is troublesome when the number of support legs is large. Furthermore, when the auxiliary table has been attached to the sewing machine, an upper surface of the auxiliary table needs to be substantially on a level with an upper surface of the sewing bed. As a result, each support leg necessitates an accurate length.

Furthermore, even in the case where each produced support leg has an accurate length, a level difference between the upper surfaces of the sewing bed and auxiliary table results from a difference between the levels of installation surfaces of the upper surfaces of the sewing bed and auxiliary table. In view of this problem, an adjusting mechanism for adjusting the height of each support leg is suggested to be provided on each support leg. However, the number of parts is increased and a height adjusting work of each mechanism is troublesome, whereupon the adjusting mechanism provides a low working efficiency.

SUMMARY

Therefore, an object of the present disclosure is to provide an auxiliary table for a sewing machine, which has improved efficiencies of attaching to and detaching from a sewing machine and in which the level difference between an upper surface of a sewing bed and the auxiliary table can be rendered as small as possible.

The present disclosure provides an auxiliary table detachably attached to a sewing machine including a sewing bed having a free arm extending leftward and a bottom plate disposed below the free arm with a predetermined space being defined therebetween. The auxiliary table comprises a plurality of engagement supports provided on the sewing bed, a table body having a plurality of engagement portions engageable with the engagement supports respectively, the table body having right and left ends, a generally U-shaped first support leg provided on the left end of the table body so as to be switchable between a substantially horizontal retraction position and a substantially vertical use position, and a generally U-shaped second support leg provided on the right end of the table body so as to be switchable between a substantially horizontal retraction position and a substantially vertical use position, the second support having a lower end. In the auxiliary table, the table body is attached to the free arm while the second support leg is located at the use position and the lower end of the second support leg is inserted in the space between the free arm and the bottom plate, and the lower end of the second support leg is placed on the bottom plate when the table body has been attached to the free arm.

The number of support legs is smaller in the above-described auxiliary table than in the conventional auxiliary tables. Accordingly, each support leg can easily be switched between the retraction position and the use position. Furthermore, since the lower end of the second support leg located at the use position is adapted to be placed on the bottom plate, a level difference can be prevented between the upper surfaces of the sewing bed and auxiliary table even when there is a difference between the levels of installation surfaces of the upper surfaces of the sewing bed and auxiliary table.

BRIEF DESCRIPTION OF THE DRAWINGS

Other objects, features and advantages of the present invention will become clear upon reviewing the following description of illustrative aspects of the invention with reference to the accompanying drawings, in which.

DETAILED DESCRIPTION OF THE INVENTION

Figure 1:
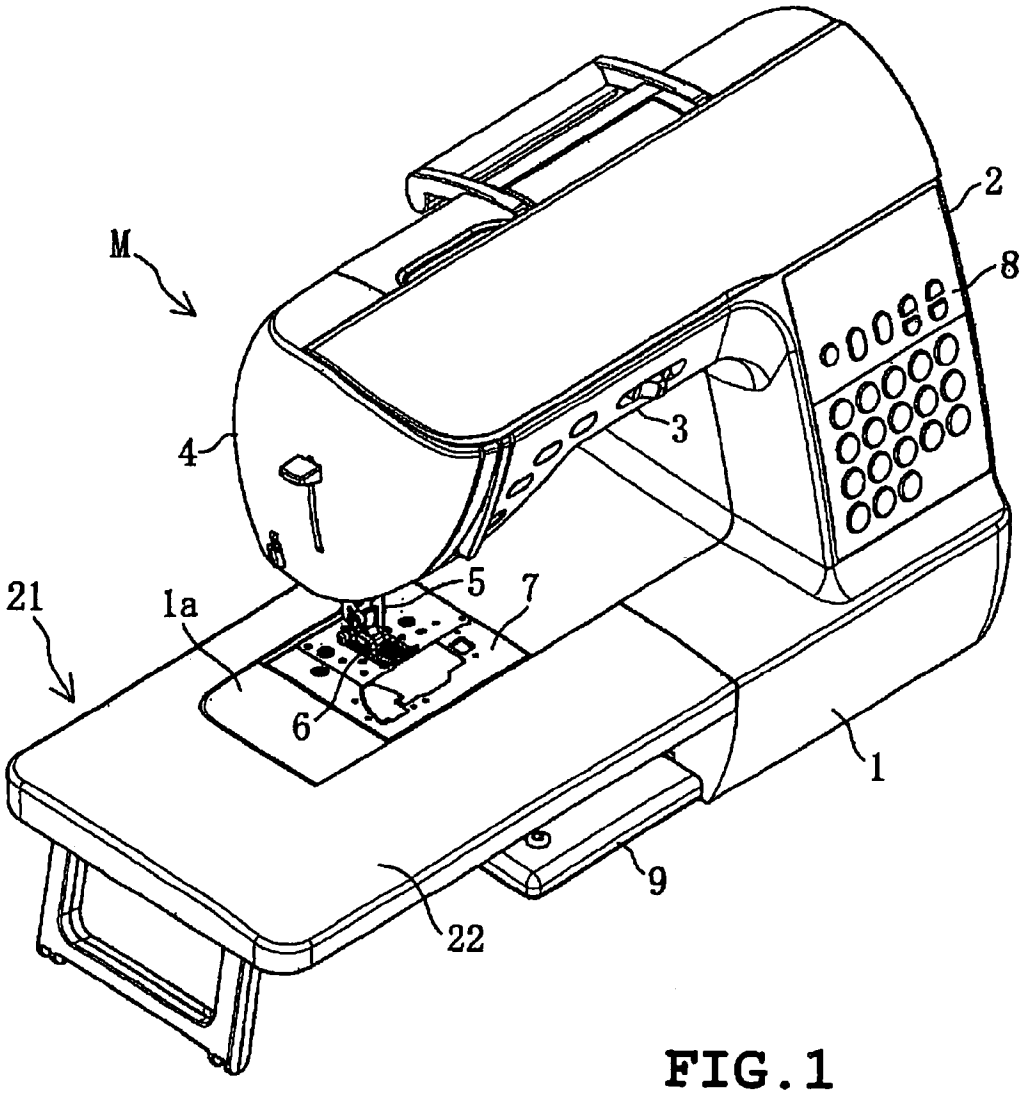
FIG. 1 is a perspective view of a sewing machine attached with an auxiliary table in accordance with one illustrative aspect of the invention.
Figure 2:
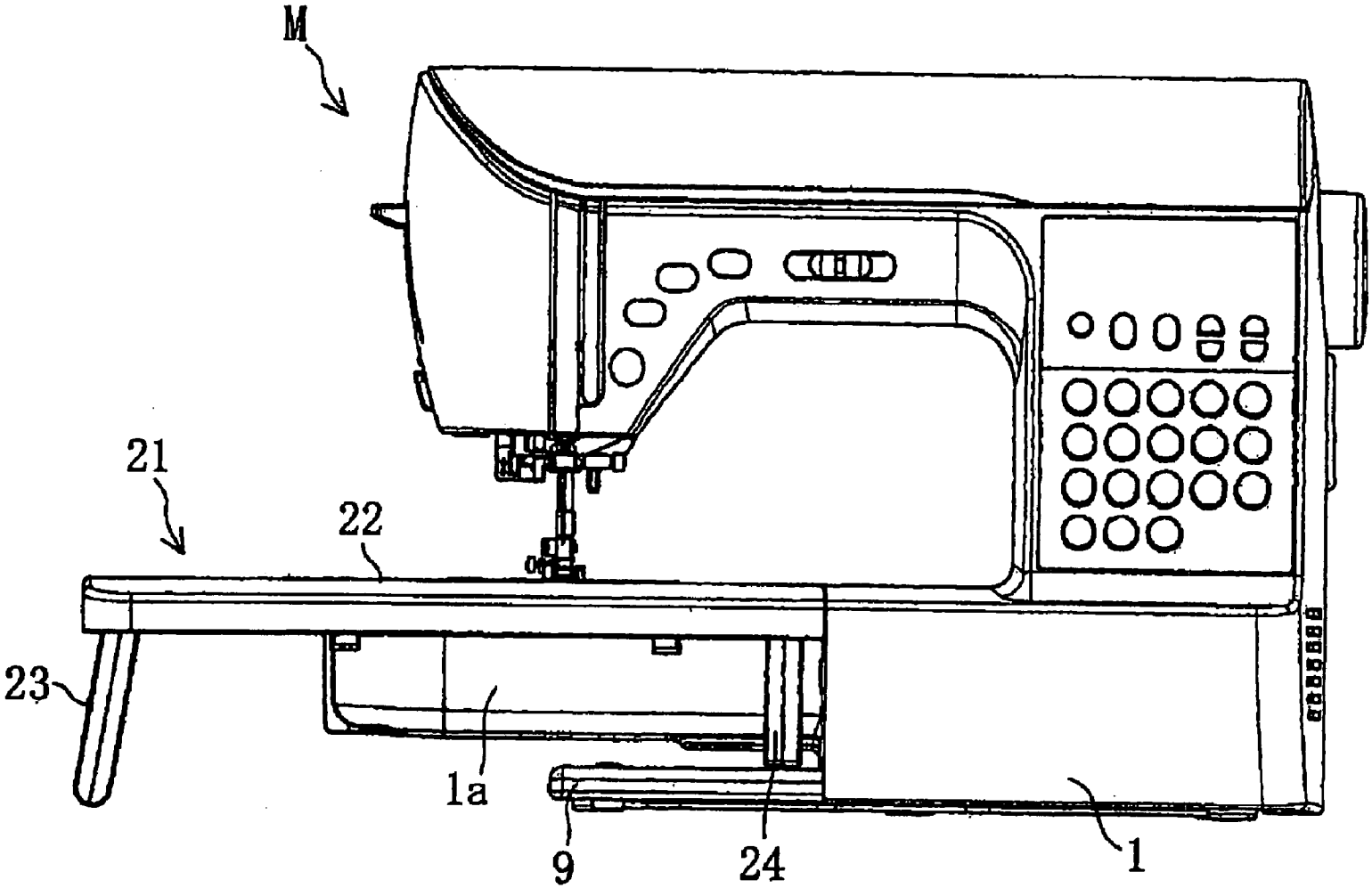
FIG. 2 is a front view of the sewing machine attached with the auxiliary table.

Several embodiments of the present invention will be described with reference to the drawings. The invention is applied to a sewing machine in the embodiments. FIGS. 1 to 8 illustrate a first embodiment. Referring to FIGS. 1 and 2, a sewing machine M includes a sewing bed 1, a pillar 2 standing on a right portion of the bed 1, an arm 3 extending leftward from an upper part of the pillar 2 so as to be opposed to the bed 1 and a head 4 mounted on a left part of the arm 3.

The head 4 is provided with a sewing needle 5, a presser foot 6 and the like. A feed dog (not shown) for feeding work cloth and a needle plate 7 are provided in the bed 1. An operation panel 8 is provided on the arm 3 and has a plurality of operation buttons. The operation buttons are operated so that instructions are supplied into a control unit (not shown) of the sewing machine M, whereby stitches of various utility patterns are sewn. A cylindrical free arm 1*a* and a bottom plate 9 are provided integrally on upper and lower portions of a left end of the bed 1 with a predetermined space being defined therebetween respectively. A generally U-shaped auxiliary table 21 is detachably attached to the free arm 1*a*.

Figure 3:
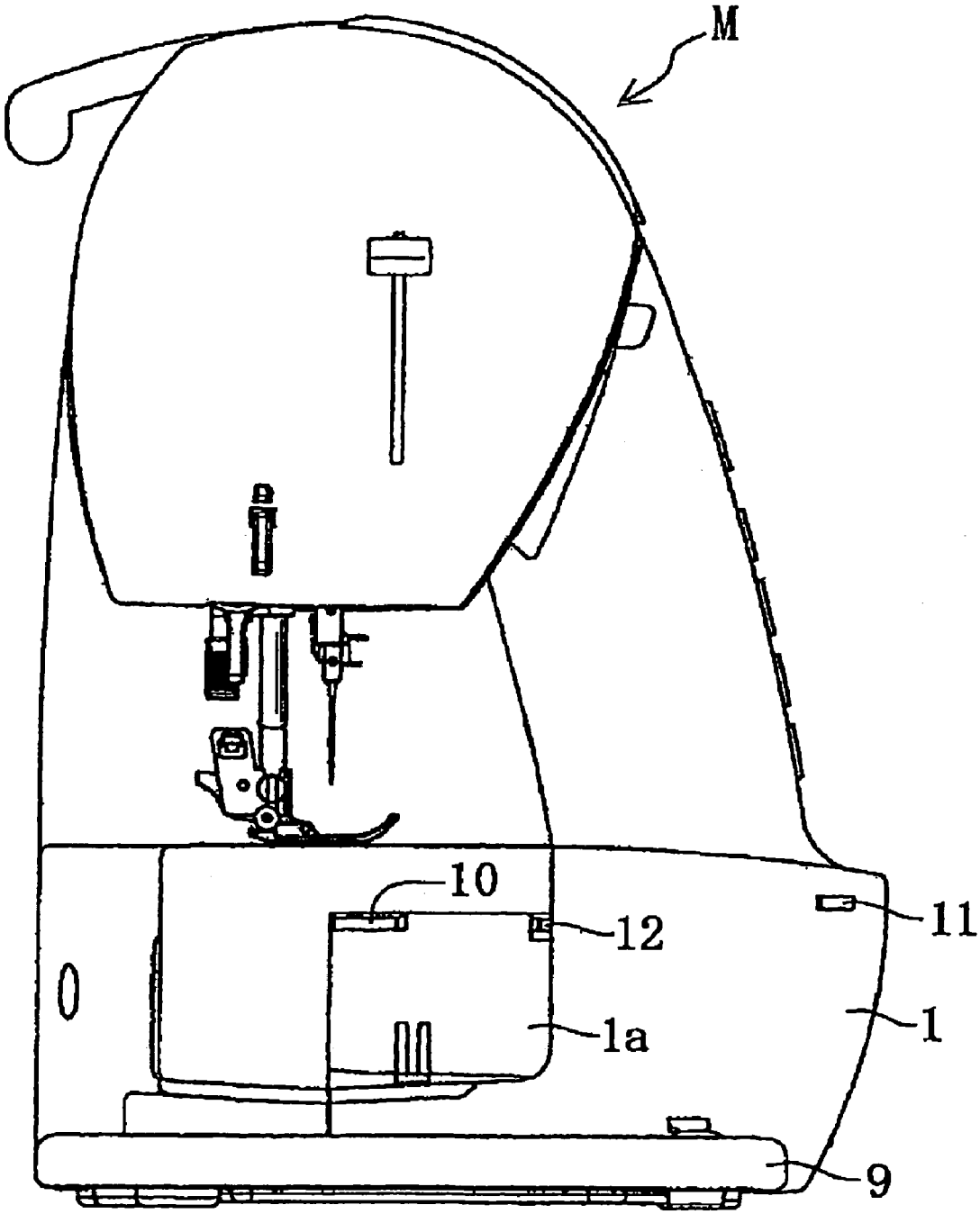
FIG. 3 is a left side view of the sewing machine with the auxiliary table being detached from a sewing bed.
Figure 4:
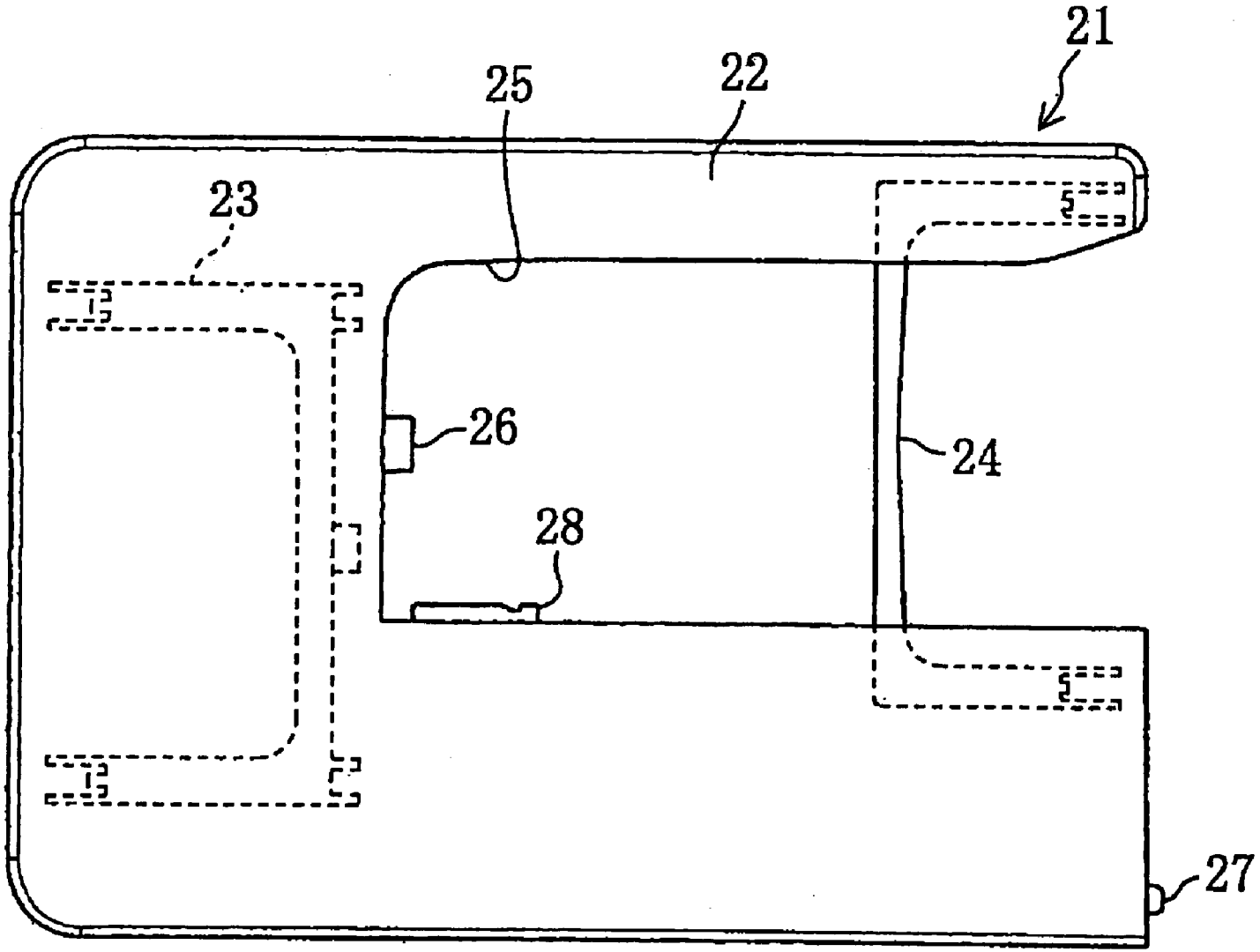
FIG. 4 is a plan view of the auxiliary table when support legs are located at respective retraction positions.
Figure 5:
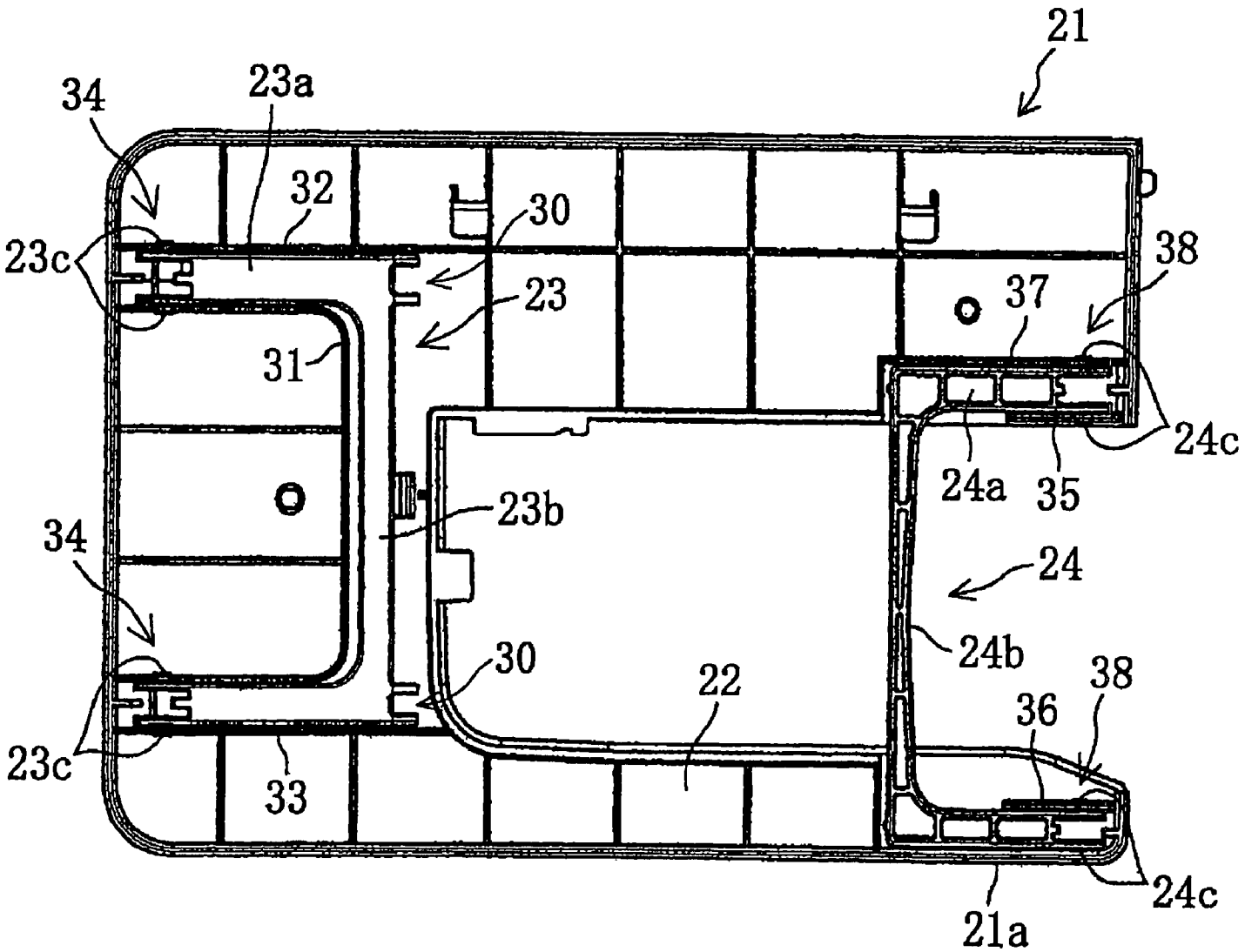
FIG. 5 is a bottom view of the auxiliary table when the support legs are located at respective retraction positions.
Figure 6:
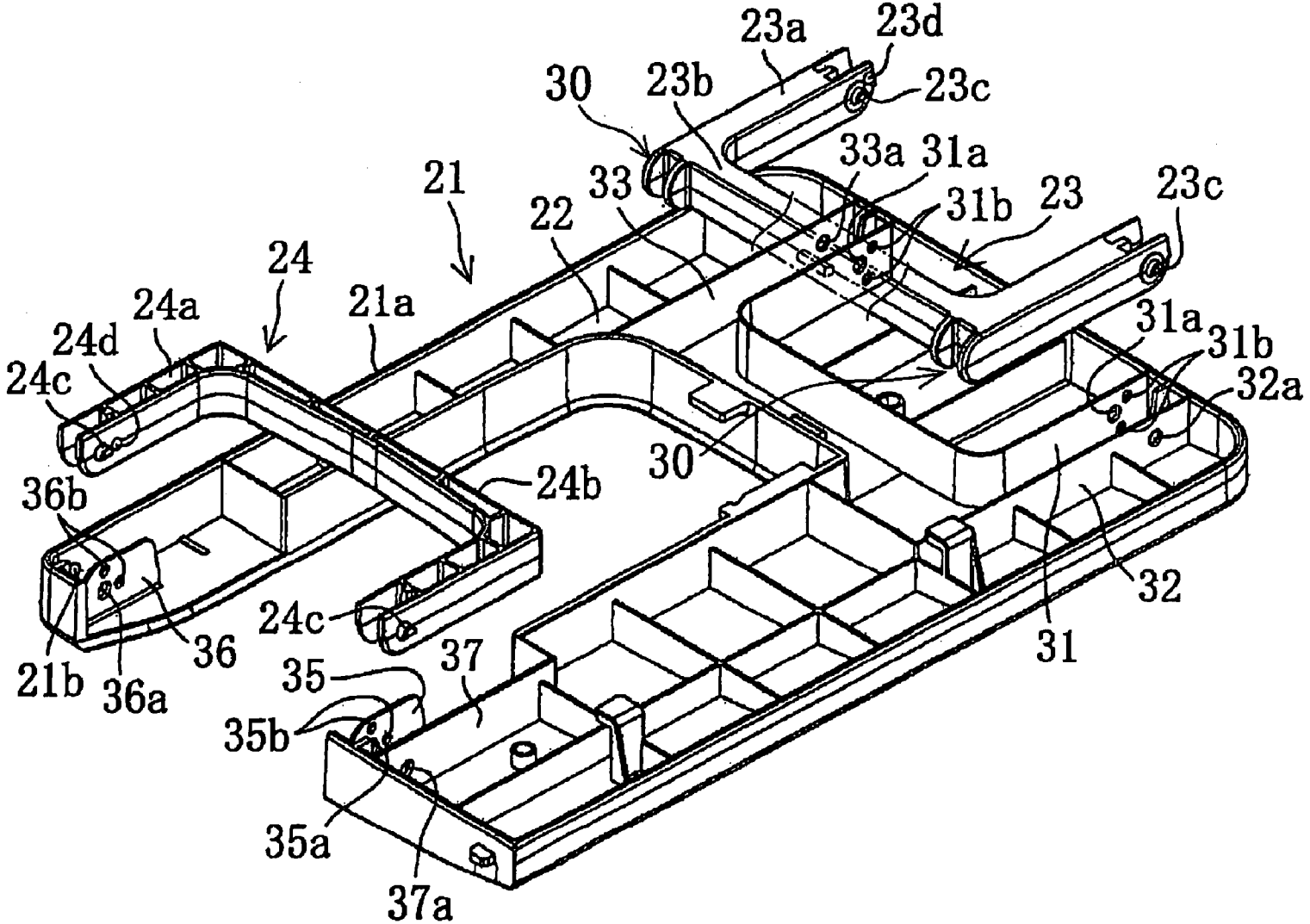
FIG. 6 is an exploded view of the auxiliary table.

The sewing machine M is provided with a separable bed (not shown) detachably attached to the bed 1. When the separable bed is detached from the bed 1, the free arm 1*a* and the bottom plate 9 are exposed such that the auxiliary table 21 is allowed to be attached to the free arm 1*a*. A recess 10 is formed in a left end face of the free arm 1*a* as shown in FIG. 3. Also, a recess 11 is formed in a front end of the left end face of the bed 1. Furthermore, a guide groove 12 is formed in a front end face of the free arm 1*a* so as to extend horizontally from a left end of the front end near to the a lower part of the needle plate 7. The recesses 10 and 11, and the guide groove 12 constitute engagement supports.

The auxiliary table 21 will now be described in detail with reference to FIGS. 2 and 4 to 8. The auxiliary table 21 includes a generally U-shaped table body 22, first and second support legs 23 and 24 mounted on left and right ends of an underside of the table body 22 respectively. The first and support legs 23 and 24 are rotatably connected to the table body 22 by connecting parts 34 and 38 respectively. The first and support legs 23 and 24 are rotatable so as to be switched between a substantially horizontal retraction position (see FIGS. 5 and 7) and a substantially vertical use position (see FIG. 8).

The table body 22 has a notch 25 formed so as to extend from a right end of thereof to the lengthwise middle. The free arm 1*a* is adapted to be fitted into the notch 25. The table body 22 includes a face located at a left end of the notch 25. The face is provided with an engagement portion 26 engaging the recess 10. Furthermore, another engagement portion 27 engaging the recess 11 is formed in the front of right end face of the table body 22. Additionally, the table body 22 has a face which corresponds to a front end of the notch 25 and is provided with an engagement portion 28 engaging the aforesaid guide groove 12.

The first support leg 23 is formed into a U-shape and includes a pair of legs 23*a* and a horizontal leg 23*b* connecting lower ends of the legs 23*a*. A pair of generally semicircular protrusions 30 are provided on both ends of the underside of the horizontal leg 23*b* respectively. The second support leg 24 is also formed into a U-shape and includes a pair of legs 24*a* and a horizontal leg 24*b* connecting lower ends of the legs 24*a*. When the second support leg 24 is located at the vertical use position, the horizontal leg 24*b* or a lower end of the second support leg 24 is inserted in a space defined between the free arm 1*a* and the bottom plate 9 thereby to be placed on the bottom plate 9 as will be described later (see FIG. 2).

A support wall 31 and two mounting walls 32 and 33 are provided on a left part of the underside of the table body 22. The support wall 31 is formed according to the shape of the first support leg 23 located at the retraction position. The mounting walls 32 and 33 extend leftward and rightward respectively along a front face of the front leg 23*a* and a rear face of the rear leg 23*a*. Furthermore, a pair of trapezoidal support walls 35 and 36 and a mounting wall 37 are provided on a right part of the underside of the table body 22. The mounting wall 37 extends leftward and rightward along a front face of the front leg 24*a*.

The paired legs 23*a* of the first support leg 23 have proximal ends provided with cylindrical shafts 23*c* protruding frontward and rearward respectively. The shaft 23*c* of the front leg 23*a* is inserted through a hole 31*a* formed through a front part of the support wall 31 and a hole 32*a* formed through the mounting wall 32. The shaft 23*c* of the rear leg 23*a* is inserted through a hole 31*a* formed through the support wall 31 and a hole 33*a* formed through the mounting wall 33. The shaft 23*c* and the holes 31*a*, 32*a* and 33*a* serve as a connecting part 34 of the first support frame 23. The first support leg 23 is caused to pivot about the shaft 23*c* of the connecting part 34 thereby to be switched between the retraction position and use position.

Figure 7:
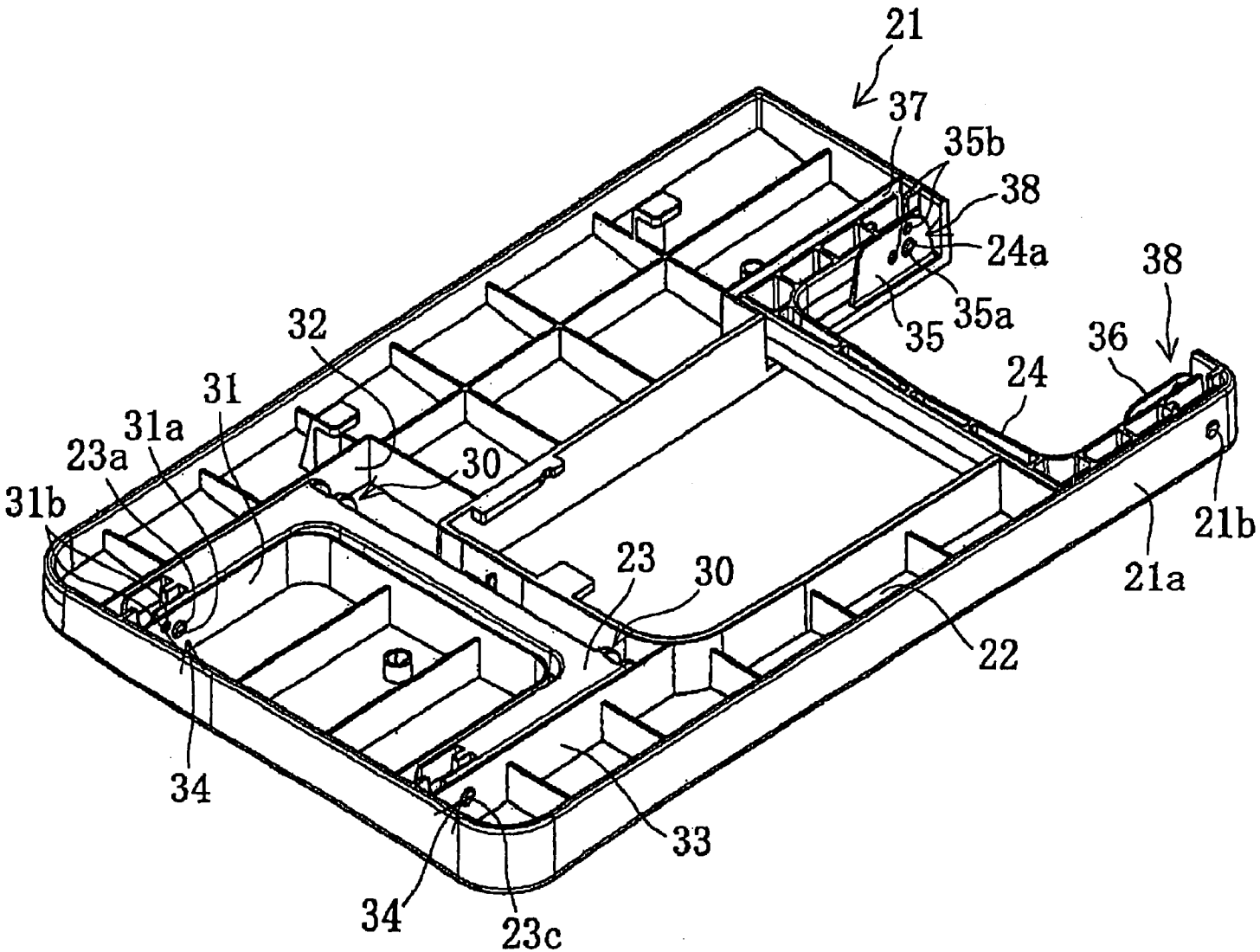
FIG. 7 is a perspective view of the auxiliary table when the support legs are located at respective retraction positions, as viewed from below.
Figure 8:
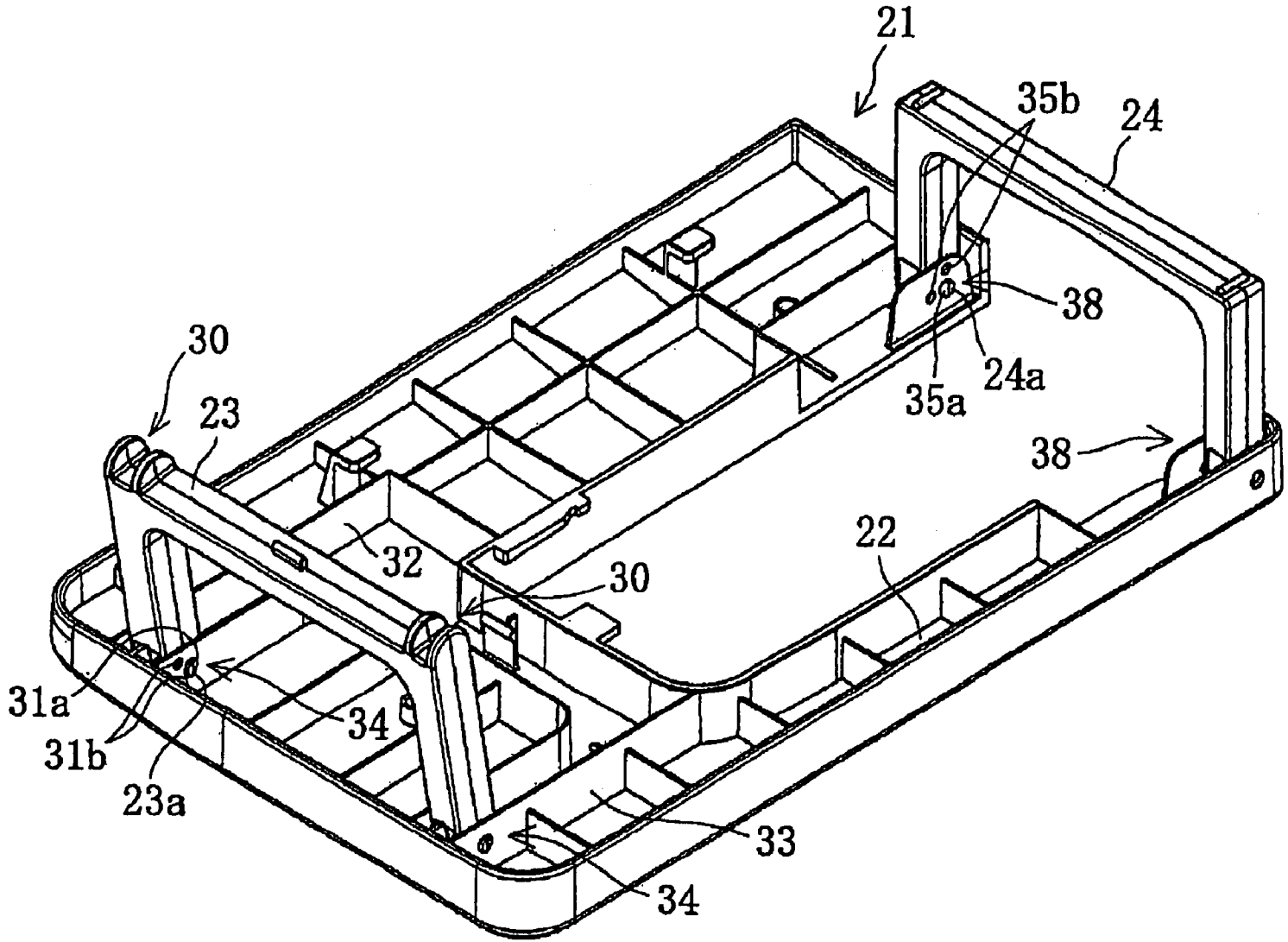
FIG. 8 is a perspective view of the auxiliary table when the support legs are located at respective use positions, as viewed from below.
Figure 9:
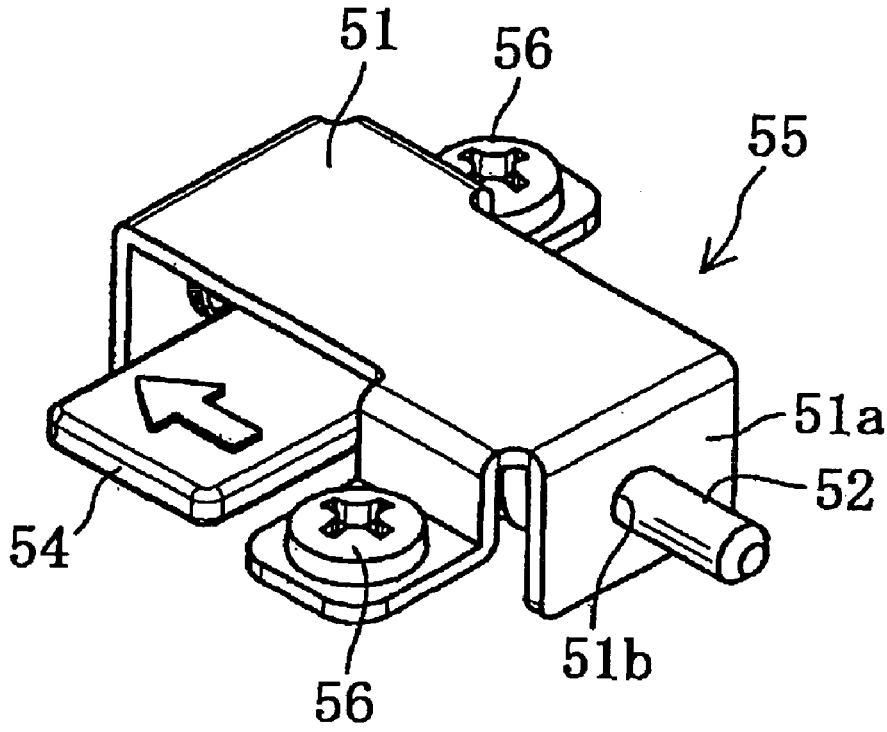
FIG. 9 is a perspective view of a rotation limiting mechanism employed in the auxiliary table of second illustrative aspect of the invention.
Figure 10:
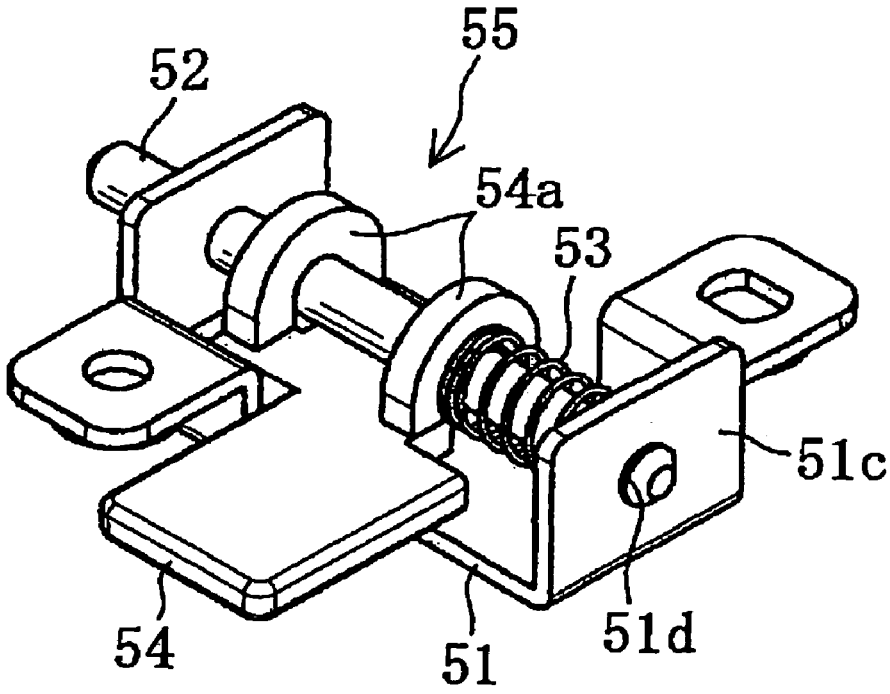
FIG. 10 is a perspective view of the rotation limiting mechanism as viewed from below.

Furthermore, two semispherical engagement protrusions 23*d* are formed on a rear face of the proximal end of the front leg 23*a* and a front face of the rear leg of the first support leg 23 respectively. Each of the front and rear walls of the support wall 31 is formed with upper and lower engagement holes 31*b* having smaller diameters than the hole 31*a*. When the first support leg 23 is located at the retraction position as shown in FIG. 7, the engagement protrusion 23*d* is fitted into the engagement hole 31*b* (located upward as viewed in FIG. 7), so that the position of the first support leg 23 is retained. On the other hand, when the first support leg 23 is located at the use position, the engagement protrusion 23*d* is fitted into the upper engagement hole 31*b* (located lower as viewed in FIG. 8), so that the position of the first support leg 23 is retained.

A pair of legs 24*a* of the second support leg 24 also have respective proximal ends provided with cylindrical shafts 24*c* and semispherical engagement protrusions 24*d* respectively as in the first support leg 23. The shaft 24*c* of the front leg 24*a* is inserted through a hole 35*a* formed through the support wall 35 and a hole 37*a* formed through the mounting wall 37. The shaft 24*c* of the rear leg 24*a* is inserted through a hole 36*a* formed through the support wall 36 and a hole

21*b* formed through the rear wall 21*a* of the auxiliary table 21. The shafts 24*c* and the holes 21*b*, 35*a*, 36*a* and 37*a* serve as a connecting part 38 in the second support shaft 24. The second support shaft 24 is caused to pivot about the shafts 24*c* of the connecting part 38 so as to be switched between the retraction position and use position.

The support walls 35 and 36 are formed with two pairs of upper and lower engagement holes 35*b* and 36*b* having diameters smaller than the holes 35*a* 36*a* respectively. When the second support leg 24 is located at the retraction position, the engagement protrusions 24*d* are fitted into the lower engagement holes 35*b* and 36*b* (located upward as viewed in FIG. 7) respectively, whereby the position of the second support leg 24 is retained. On the other hand, when the second support leg 24 is located at the use position, the engagement protrusions 24*d* are fitted into the upper engagement holes 35*b* and 36*b* (located lower as viewed in FIG. 8) respectively, whereby the position of the second support leg 24 is retained.

The operation of the sewing machine will now be described. Firstly, the separable bed is detached from the bed 1 so that the free arm 1*a* and the bottom plate 9 are exposed. As a result, the auxiliary table 21 is allowed to be attached to the free arm 1*a*. The first and second support legs 23 and 24 of the auxiliary table 21 are then rotated so as to be switched from the retraction positions to the use positions. The auxiliary table 21 is moved from the left of the free arm 1*a* rightward along the free arm 1*a* so that the free arm 1*a* is introduced into the notch 25 of the table body 25. In this case, the auxiliary table 21 is moved so that the free arm 1*a* passes through the space defined between the legs 24*a* of the second support leg 24 and the horizontal leg 24*b*. When the engagement portion 28 of the table body 22 is fitted into the guide groove 12 of the free arm 1*a* from the right side, the table body 22 is slid rightward while being held in a horizontal state, so that the recesses 10 and 11, and guide groove 12 are engaged with the engagement portions 26, 27 and 28 respectively. Consequently, the auxiliary table 21 is attached to the free arm 1*a*. The auxiliary table is adapted to be kept attached to the free arm 1*a* even when the first support leg 23 is caused to pivot to be switched into the retraction position.

When the auxiliary table 21 is to be detached from the free arm 1*a*, the table body 22 is pulled out of free arm 1*a* in an order reverse to the above-described. The first and second support legs 23 and 24 are caused to pivot thereby to be switched into the retraction positions.

Since the first and second U-shaped support legs 23 and 24 are provided on the table body 22 in the foregoing embodiment, the number of support legs in the embodiment is rendered smaller than in the conventional auxiliary tables. Accordingly, the reduction in the number of support legs considerably simplifies switching of the first and second support legs 23 and 24 between the retraction positions and use positions respectively when the auxiliary table 21 is attached to and detached from the free arm 1*a*. Moreover, since the first and second support legs are pivotable about the connecting portions 34 and 38, the first and second support legs 23 and 24 can efficiently be switched.

Furthermore, since each of the support legs 23 and 24 is generally formed into a U-shape, the strength of each leg switched to the use position can be improved as compared with the conventional auxiliary tables. Consequently, the auxiliary table can sufficiently bear a large load even when the number of support legs is reduced. Furthermore, the horizontal leg 24*b* of the second support leg 24 is inserted into the space defined between the free arm 1*a* and the bottom plate 9 thereby to be placed on the bottom plate. Accordingly, even when a workbench on which the sewing machine M is installed has a level difference, sewing can be carried out desirably without level difference in the joint between the auxiliary table 21 and the bed 1. A level difference between installation surfaces of the first support leg 23 and bed 1 results in a level difference between the upper surface of the left end of the auxiliary table 21 and the installation surface of the free arm 1*a*. However, since the upper surface of the left end of the auxiliary table 21 is spaced away from the needle plate 7 serving as the sewing area, the level difference between the upper surfaces of the left end of the auxiliary table 21 and the free arm 1*a* has only a small adverse effect on the sewing work.

Furthermore, the horizontal leg 24*b* of the second support leg 24 is placed on the bottom plate 9 in the foregoing embodiment. The placement of the leg 24*b* on the bottom plate 9 necessitates no adjusting mechanism for adjusting the heights of the first and second support legs 23 and 24. Consequently, an increase in the number of parts can be limited. Still furthermore, even when the first support leg 23 is switched to the retraction position, the auxiliary table 21 can be retained in attachment to the free arm 1*a* by the engagement of the recesses 10 and 11, and the guide groove 12 with the engagement portions 26 to 28 and further by the second support leg 24 supporting the table body 22. As a result, cylindrical work cloth can be sewn by the sewing machine of the embodiment. Additionally, since the semi-circular protrusion 30 is formed on the underside of the horizontal leg 23*b* of the first support leg 23, the first support leg can smoothly be switched from use position to the retraction position while the auxiliary table 21 is kept attached to the free arm 1*a*.

FIGS. 9 to 12 illustrate a second embodiment of the invention. The following describes only the difference of the second embodiment from the first embodiment. Identical or similar parts in the second embodiment are labeled by the same reference symbols as in the first embodiment. In the second embodiment, a pivot limiting mechanism 55 is provided for limiting pivot of the second support leg 24 in the case where the second support leg is located at the use position.

The pivot limiting mechanism 55 includes a support piece 51, a limiting pin 52 (serving as a limiting member), a coil spring 53 urging the limiting pin 52 toward a limiting position and a release lever 54 (serving as an operating part) for moving the limiting pin 53 to a retreat position. The support piece 51 is fixed by a screw 56 to the table body 22 so as to be located near the connecting part 38 of the second support leg 24. The support piece 51 has a rear wall 51*a* with a through hole 51*b* and a front wall 51*c* with a through hole 51*d*. The limiting pin 52 is inserted through the holes 51*b* and 51*d*. The release lever 54 has an underside on which two supports 54*a* are integrally provided. The supports 54*a* are secured to a portion of the limiting pin 52 located between the holes 51*b* and 51*d*, whereupon the limiting pin 52 and the release lever 54 are adapted to be moved together. Furthermore, a coil spring 53 is provided about the limiting pin 52 so as to be located between the support 54*a* located at the front of the limiting pin and the front wall 51*c* of the support piece 51. The limiting pin 52 is urged by a spring force of the coil spring 53 so as to be located at a limiting position where the pin 52 protrudes ahead of the front wall 51*a* of the support piece 51. The release lever 54 is operated so that the limiting pin 52 can be switched to a retreat position where the limiting pin does not protrude ahead of the front wall 51*a*.

Figure 11:
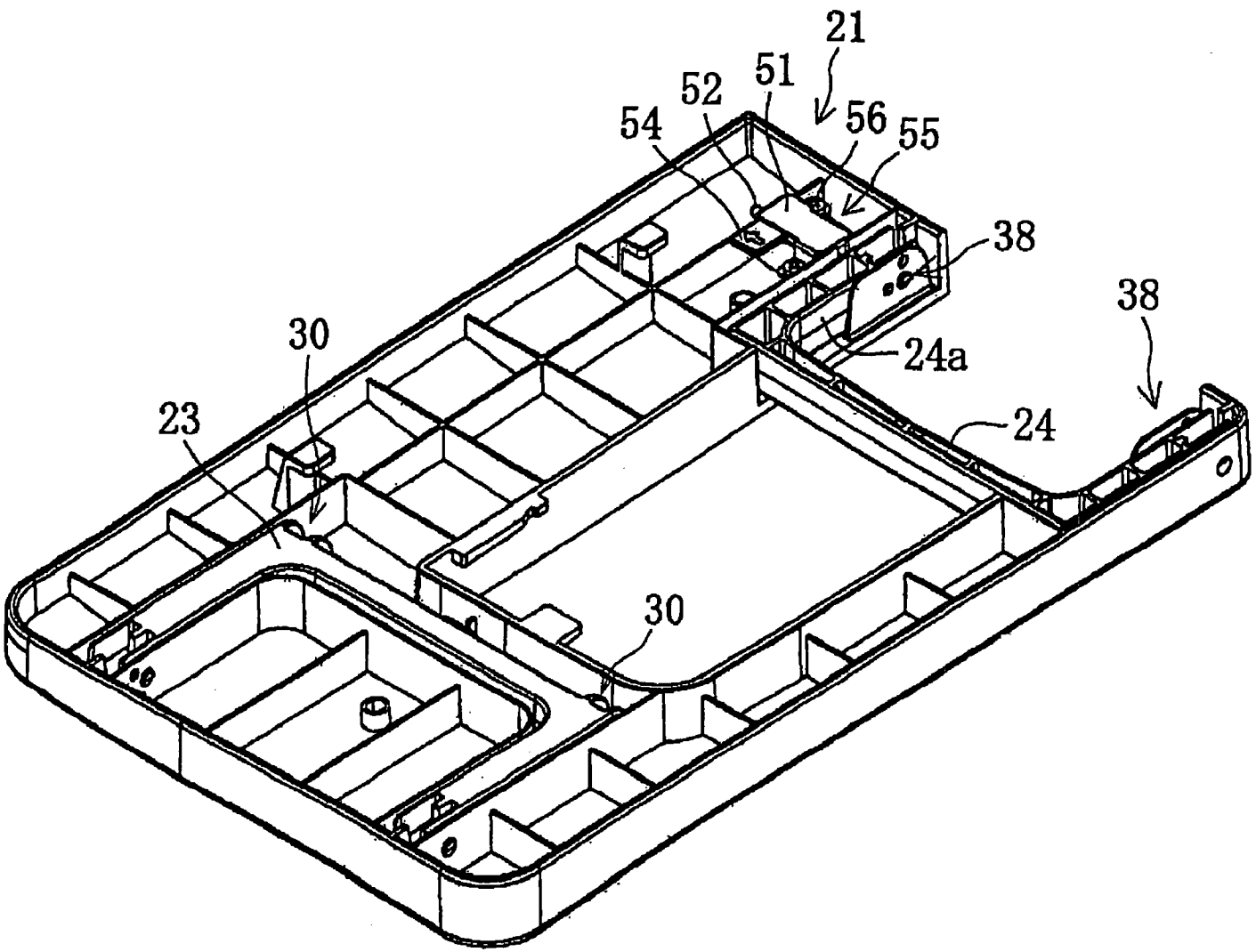
FIG. 11 is a view similar to FIG. 7.
Figure 12:
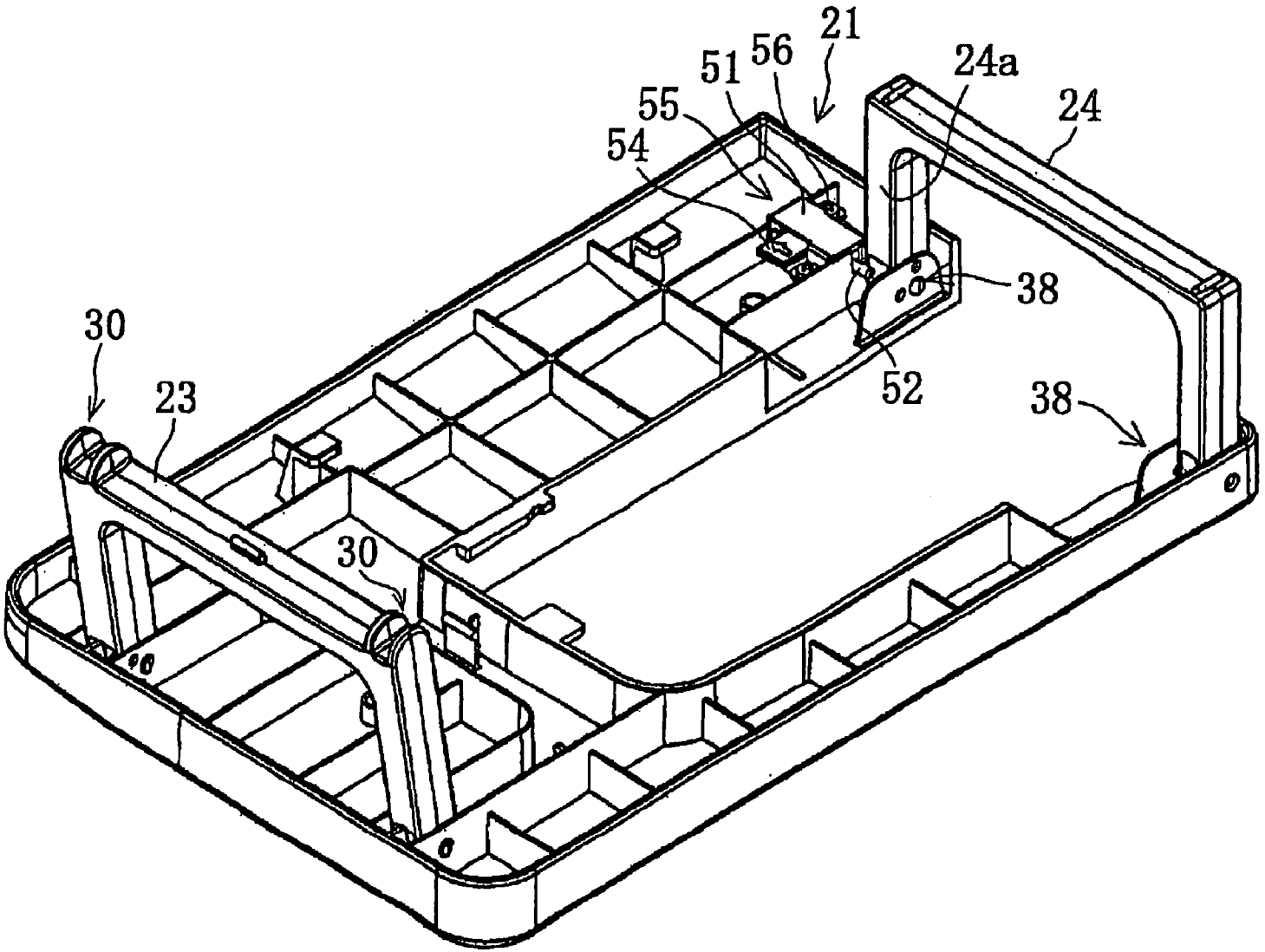
FIG. 12 is a view similar to FIG. 8.

The limiting pin 52 is located at the retreat position with a distal end thereof in abutment with the leg 24*a* of the second support leg 24 when the second support leg 24 is located at the retraction position, as shown in FIG. 11. On the other hand, when the auxiliary table 21 is to be attached to the bed 1, the second support leg 24 is caused to pivot to be switched from the retraction position to the use position. As a result, the leg 24*a* of the second support leg 24 is released from abutment with the limiting pin 52. Then, the spring force of the coil spring 53 switches the limiting pin 52 to the limiting position. When the auxiliary table 21 detached from the bed 1 is to be retraction, the second support leg 24 is caused to pivot while the release lever 54 is moved forward by a finger so that the limiting pin 52 is switched to the retreat position.

The limiting pin 52 is thus switched to the limiting position by the urging force of the coil spring 53 when the second support leg 24 is switched to the use position. As a result, the second support leg 24 can be prevented from pivoting toward the retraction position and accordingly can reliably be retained at the use position. Consequently, when the auxiliary table 21 is inserted into the space between the free arm 1*a* and the lower bottom plate 9, the second support leg 24 need not be supported by user's hand so that the second support leg is prevented from coming into contact with the bottom plate 9 thereby to pivot toward the retraction position. As a result, the workability during attachment can be improved. The other construction of the auxiliary table in the second embodiment is the same as in the first embodiment. The auxiliary table 21 of the second embodiment operates substantially in the same manner as described in the first embodiment, and the same effect can be achieved from the second embodiment as from the first embodiment.

Figure 13:
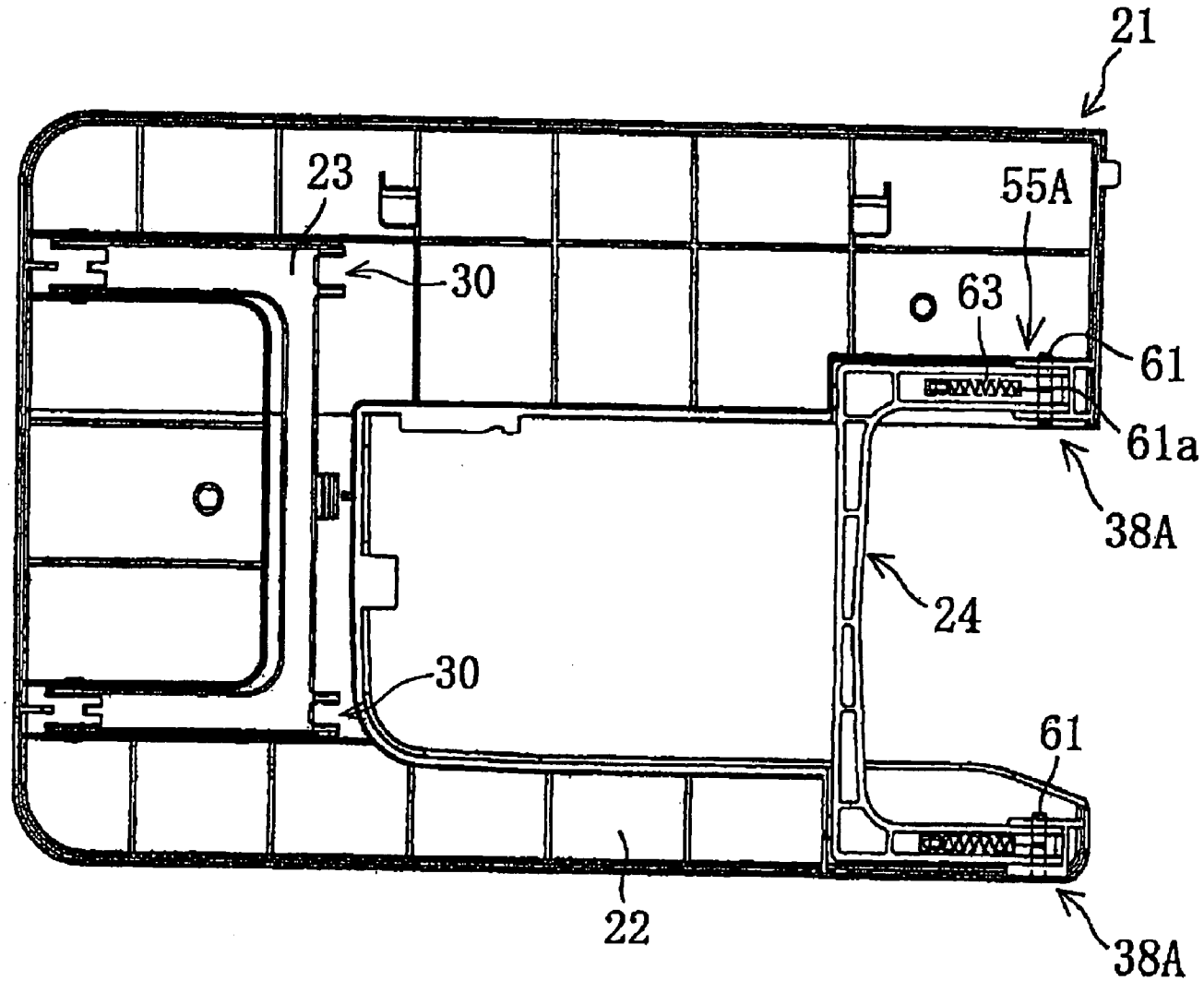
FIG. 13 is a view similar to FIG. 5, showing a third illustrative aspect of the invention.
Figure 14A:
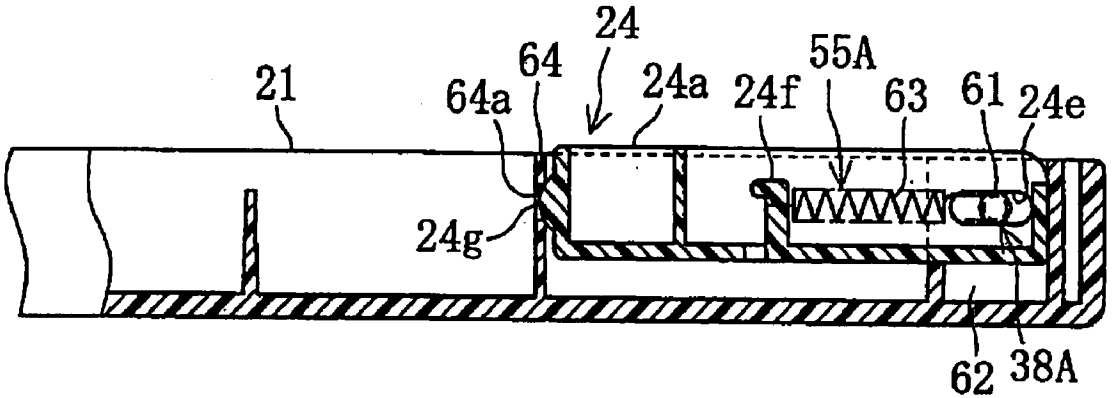
FIG. 14A is a sectional view of the rotation limiting mechanism and a part of the second support leg located at the retraction position.
Figure 14B:
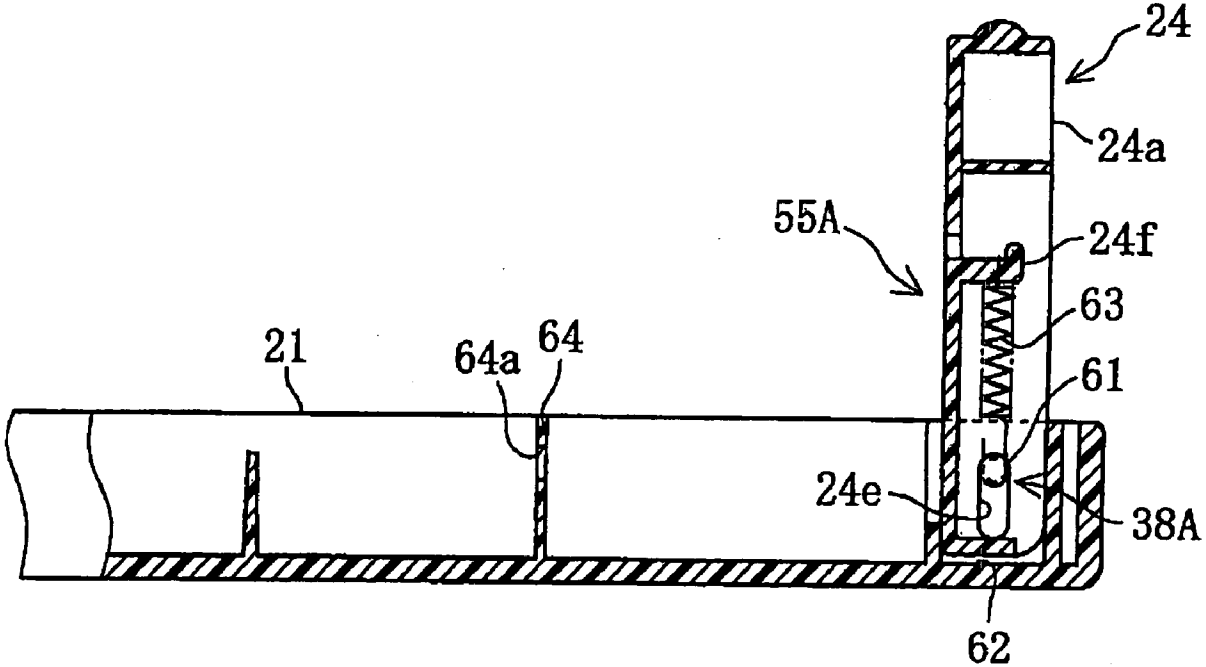
FIG. 14B is a sectional view of the rotation limiting mechanism and a part of the second support leg located at the use position.

FIGS. 13 to 14B illustrate a third embodiment of the invention. The following describes only the difference of the third embodiment from the first embodiment. Identical or similar parts in the third embodiment are labeled by the same reference symbols as in the first embodiment.

The third embodiment employs a pivot limiting mechanism having the construction differing from that of the pivot limiting mechanism 55 in the second embodiment. More specifically, a pivot limiting mechanism 55A includes a support pin 61 secured to the table body 22, an engagement recess 62 provided in the table body 22, an elongate hole 24*e* formed in the proximal end of the second support leg 24 and a coil spring 63. The elongate hole 24*e* extends from a proximal end (upper end) of the leg 24*a* of the second support leg 24 toward a distal end of the leg. The support pin 61 is inserted through the elongate hole 24*e*, so that the second support leg 24 and the table body 22 are connected together. Furthermore, the second support leg 24 is connected to the table body 22 so as to be pivotable about the support pin 66 and movable along the elongate hole 24*e*. In the embodiment, the elongate hole 24*e* and the support pin 61 serve as a connecting portion 38A.

The engagement recess 62 is defined by two walls which are formed on the right underside of the table body 22 and have heights different from each other. While the second support leg 24 is being switched to the use position, the proximal end of the leg 24*a* fitted into the engagement recess 62, whereby the second support leg 24 is unable to pivot.

The coil spring 63 is located between a groove 61*a* formed in the vicinity of the central part of the support pin 61 and a generally L-shaped mounting wall 24*f* formed on the leg 24*a*. While the second support leg 24 is being switched to the use position, the coil spring urges the proximal end of the leg 24*a* in such a direction that the proximal end engages the engagement recess 62.

The support pin 61 is located near the center of the elongate hole 24*e* when the second support leg 24 is located at the retraction position, as shown in FIG. 14A. Accordingly, the coil spring 63 is in an expanded state. When the auxiliary table 21 is inserted into the space between the free arm 1*a* and the lower bottom plate 9, the second support leg 24 is caused to pivot gradually from the retraction position toward the use position. When a predetermined pivot angle is reached, the second support leg 24 is pulled toward the support pin 61 by the urging force of the coil spring 63. Then, the upper end of the leg 24*a* engages the engagement recess 62, so that the second support leg 24 is switched to the use position (see FIG. 14B).

On the other hand, when the auxiliary table 21 is to be retraction, the auxiliary table 21 is detached from the free arm 1*a* and the first and second support legs 23 and 24 are switched to the respective retraction positions in an order reverse to the above-described order. In this case, the second support leg 24 is caused to pivot into the retraction position while being pulled vertically (see FIG. 14A). In this case, the protrusion 24*g* formed on the bottom of the leg 24*a* engages the engagement hole 64*a* formed in an accommodation wall 64 of the table body 22. As a result, the second support leg 24 located at the retraction position can be prevented from inadvertently pivoting toward the use position.

According to the third embodiment, the second support leg 24 can be prevented from pivot toward the retraction position by the urging force of the coil spring 63 and the engagement recess 62 provided in the table body 22. Consequently, the second support leg 24 can reliably be retained at the use position. The other construction of the auxiliary table in the third embodiment is the same as in the first embodiment. The auxiliary table 21 of the third embodiment operates substantially in the same manner as described in the first embodiment, and the same effect can be achieved from the third embodiment as from the second embodiment.

The invention should not be limited by the foregoing embodiments. The embodiments may be modified as follows:

1) The positions of the engagement supports 10 to 12 provided on the free arm 1*a* may be changed suitably. Furthermore, the engagement portions 26 to 28 provided in the table body 22 may also be changed. Additionally, the number of engagement supports and engagement portions may also be changed.

2) The pivot limiting mechanism 55 or 55A is provided for limiting pivotal movement of the second support leg 24 when the second support leg 24 is located at the use position in each of the foregoing embodiments. However, a pivot limiting mechanism may be provided for limiting pivotal movement of the first support leg 23 when the first support leg 23 is located at the use position, instead.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. An auxiliary table detachably attached to a sewing machine including a sewing bed having a free arm extending leftward and a bottom plate disposed below the free arm with a predetermined space being defined therebetween, the auxiliary table comprising:

a plurality of engagement supports provided on the sewing bed;

a table body having a plurality of engagement portions engageable with the engagement supports respectively, the table body having right and left ends;

a generally U-shaped first support leg provided on the left end of the table body so as to be switchable between a substantially horizontal retraction position and a substantially vertical use position; and a generally U-shaped second support leg provided on the right end of the table body so as to be switchable between a substantially horizontal retraction position and a substantially vertical use position, the second support having a lower end, wherein the table body is attached to the free arm while the second support leg is located at the use position and the lower end of the second support leg is inserted in the space between the free arm and the bottom plate, and the lower end of the second support leg is placed on the bottom plate when the table body has been attached to the free arm.

2. The auxiliary table according to claim 1, wherein the table body is retained in an attached state relative to the free arm by engagement of the engagement portions with the engagement supports respectively and by the second support leg.

3. The auxiliary table according to claim 1, further comprising a plurality of connecting parts connecting the first and second support legs to the table body respectively, wherein each of the first and second support legs is switched between the retraction position and the use position by rotating each support leg about each corresponding connecting part.

4. The auxiliary table according to claim 3, further comprising a pivot limiting mechanism which limits pivotal movement of the second support leg when the second support leg is located at the use position.

5. The auxiliary table according to claim 4, wherein the rotation limiting mechanism includes:

a support piece fixed to the table body in the vanity of the connecting parts;

a limiting member attached to the support piece so as to be switchable between a limiting position where the limiting member limits pivotal movement of the second support leg from the use position to a retraction position and the retraction position where the limiting member is retracted from the limiting position;

an elastic member urging the limiting member to the limiting position; and an operating part moving the limiting member to the retraction position.

6. The auxiliary table according to claim 4, wherein the second support leg has an upper end and the pivot limiting mechanism includes:

a support pin secured to the table body;

an engagement recess provided in the table body so as to engage the upper end of the second support leg so that the second support leg is disallowed to pivot when the second support leg is located at the use position;

an elongate hole formed in the connecting part of the second support leg for holding the second support leg so that the second support leg is pivotable relative to the support pin and movable in a direction of elongation of the second support leg; and an elastic member urging the upper end of the second support leg relative to the support pin in such a direction that the upper end of the second support leg engages the engagement recess.

7. The auxiliary table according to claim 1, wherein the first support leg has a lower end provided with a semicircular protrusion.

8. A sewing machine which includes a sewing bed having a free arm extending leftward and a bottom plate disposed below the free arm with a predetermined space being defined therebetween, the sewing machine comprising:

a plurality of engagement portions provided in the auxiliary table;

a plurality of engagement supports provided on the sewing bed so as to be engageable with the engagement portions respectively;

a generally U-shaped first support leg provided on the left end of the table body so as to be switchable between a substantially horizontal retraction position and a substantially vertical use position;

a generally U-shaped second support leg provided on the right end of the table body so as to be switchable between a substantially horizontal retraction position and a substantially vertical use position, the second support having a lower end, wherein the table body is attached to the free arm while the second support leg is located at the use position and the lower end of the second support leg is inserted in the space between the free arm and the bottom plate, and the lower end of the second support leg is placed on the bottom plate when the table body has been attached to the free arm.

9. The sewing machine according to claim 8, wherein the free arm has a left end and the auxiliary table has a right end; the engagement supports are formed in the vicinity of the left end of the free arm and a part of the sewing bed against which the right end of the auxiliary table abuts; and the auxiliary table is held in an attached position by engagement of the engagement portions with the engagement supports respectively when the first support leg is switched from the use position to the retraction position while the auxiliary table is in attachment to the free arm.

* * * * *